United States Patent [19]

Walker et al.

[11] 4,341,299

[45] Jul. 27, 1982

[54] APPARATUS FOR PERFORMING OPERATIONS ON A STACK OF SHEETS

[75] Inventors: Roger Walker, Nantwich; Alan Holdsworth, Broadstone, both of England

[73] Assignee: McCorquodale Machine Systems Limited, Basingstoke, England

[21] Appl. No.: 147,788

[22] Filed: May 8, 1980

[51] Int. Cl.[3] ..... B65G 47/26

[52] U.S. Cl. ..... 198/434; 271/233; 271/236; 271/244; 414/28

[58] Field of Search ..... 198/345, 434; 271/233, 271/236, 235, 243, 244, 245, 271, 269; 414/28; 270/53; 227/50, 99; 112/21

[56] References Cited

U.S. PATENT DOCUMENTS

| | | | |
|---|---|---|---|
| 3,554,531 | 1/1971 | Heigl et al. | 270/53 |
| 3,655,078 | 4/1972 | Androkitis | 198/434 |
| 4,203,694 | 5/1980 | James | 198/434 |

FOREIGN PATENT DOCUMENTS

| | | | |
|---|---|---|---|
| 2405074 | 9/1974 | Fed. Rep. of Germany | 270/53 |
| 51-115515 | 9/1980 | Japan | 198/345 |
| 1118159 | 6/1968 | United Kingdom | 198/345 |

*Primary Examiner*—Joseph E. Valenza

*Attorney, Agent, or Firm*—Sughrue, Mion, Zinn, Macpeak and Seas

[57] ABSTRACT

In apparatus for conveying successive stacks of sheets to a station at which an operation is to be performed on the stack, the sheets are advanced by pushing elements (14) to the station, at which a resilient finger (17) projects through a slot (16) in the track. The finger (17) aligns the leading edges of the sheets in the stack. When the stack of sheets is to be advanced, a slide (20) retracts. The finger (17) is pivotally mounted on the slide and its upper inclined edge engages the bottom rear corner of the slot when the slide is retracted, causing the finger to sink below the track until the slide is returned in time for the alignment of the next stack.

7 Claims, 6 Drawing Figures

APPARATUS FOR PERFORMING OPERATIONS ON A STACK OF SHEETS

This invention relates to apparatus for performing operations upon a stack of sheets. The apparatus may, for example, perform a stitching or binding operation on the stack of sheets.

It is known to convey a stack of sheets to a station at which an operation is to be performed by placing the stack between leading and trailing locating elements on a moving conveyor. In one known form of apparatus, the stack of sheets is dropped between front and rear location elements as they pass around a turn about an axis transverse to the track, the turn having the effect of separating the outer ends of the front and rear locating elements to form a somewhat V-shaped receptable for the stack. A major disadvantage of such an arrangement is that documents of a different size cannot be handled without adjusting the leading conveyor elements by some mechanical means. A further disadvantage is that it is difficult to remove a sheet from the stack between the front and rear locating elements when the conveyor is again moving in a linear direction and the front and rear locating elements are again parallel to one another.

It has also been proposed, in British Pat. No. 354963, to align the sheets of a stack, which is being moved along a track by a moving pusher element, by providing a transverse row of fingers mounted for pivotal motion between a first position, to which they are urged by a spring, in which they project through holes in the track into the path of the sheets and a second position in which they are entirely below the track surface. The fingers are pivoted from their first to their second position by the movement of a stack of sheets across the surface under the influence of the pusher element, the fingers having an aligning effect on the leading edges of the sheets of the stack until such pivotal movement takes place. The accuracy of alignment which can be achieved by such an arrangement is however not very high.

According to the present invention, a sheet-conveying apparatus comprises stack-pushing means for engaging the trailing edge of a stack of sheets loaded on to a stationary conveyor track, a stack-aligning element movable between a first position in which it projects from the track so as to engage and align the leading edges of the sheets of a stack and a second position in which it is withdrawn below the track, and means for halting the stack-pushing means when the stack of sheets has been advanced along the track to a station at which an operation is to be performed on the stack, and further comprises mounting means positioning the stack-aligning element at the said station and comprising resilient means permitting yielding movement of the element in the direction of movement of the conveyor while the element is in its first position, so that the sheets are urged into alignment to form a compact stack between the said resiliently mounted stack-alignment element and the stack pushing means, and means operating in timed relationship with further movement of the conveyor for withdrawing the resiliently mounted element to the second position to permit the stack to advance beyond the said station.

In apparatus embodying the invention, the sheets of a stack are aligned against an element which during such alignment is resiliently movable in a substantially linear manner in the direction of movement of the sheets; the apparatus does not rely upon the force exerted on the alignment element by the sheet stack to displace the element below the surface, this being effected by a driving means in timed relationship with further movement of the conveyor, following the operation on the stack of sheets at the said station. It will be clear that better alignment of the leading edges of the sheets can be achieved using an aligning surface which is resiliently movable in the direction of movement of the sheets; moreover, no adjustment of the aligning element is required for quite large variations in the dimension of the sheets in the direction of their movement.

In the preferred arrangement, the stack of sheets is pushed along a stationary track by two pushing elements attached to two conveyor chains travelling below the surface of the track.

Since during its movement towards the station at which the operation is to be performed, the stack of sheets is not constrained at its leading edge, it is now easy to remove the sheets for inspection.

The accuracy of location of the sheet stack may be improved still further and this may be desirable for certain operations. Thus, for the operation of binding a stack of individual cheques to form a cheque book, it is customary to advance the stack of cheques with their lengths transverse to the conveyor length, so that one end of the stack of sheets is presented to a binding station at one side of the track. If the stack of cheques is not accurately positioned in relation to the binding station, the binding tape will overhang at one end of the bound edge of the cheque book and will be short at the other end.

To overcome this problem, the apparatus preferably comprises a positioning device arranged for movement into the said path of the sheet stack at a predetermined point immediately after a stack has passed that point and operative, when the stack is at the station at which the operation is to be performed, to push that stack against the resiliently mounted element to an accurately defined position. It will be appreciated that the position of such a device may be controlled much more accurately than the positions of, for example, dogs attached to a chain conveyor. As an example, a plate may be freely mounted between side members for pivotal movement about an axis parallel to the axis of a shaft to which the side members are attached, the distance between the shaft and the track and the sizes of the components being such that the plate normally lies inclined to the track with its edge remote from the shaft resting on the track. When a stack of sheets reaches the plate, the stack pushes up the outer edge of the plate and passes underneath the plate. Once the stack has passed, the plate again drops on to the track and, when the stack has stopped at the station, the shaft is turned in a direction such that the edge of the plate remote from the shaft slides along the track and pushes the stack, against the force exerted by the resiliently mounted element, to the required position.

In order that the invention may be better understood, an example of apparatus embodying the invention will now be described with reference to the accompanying drawings; in which.

Figure 1:
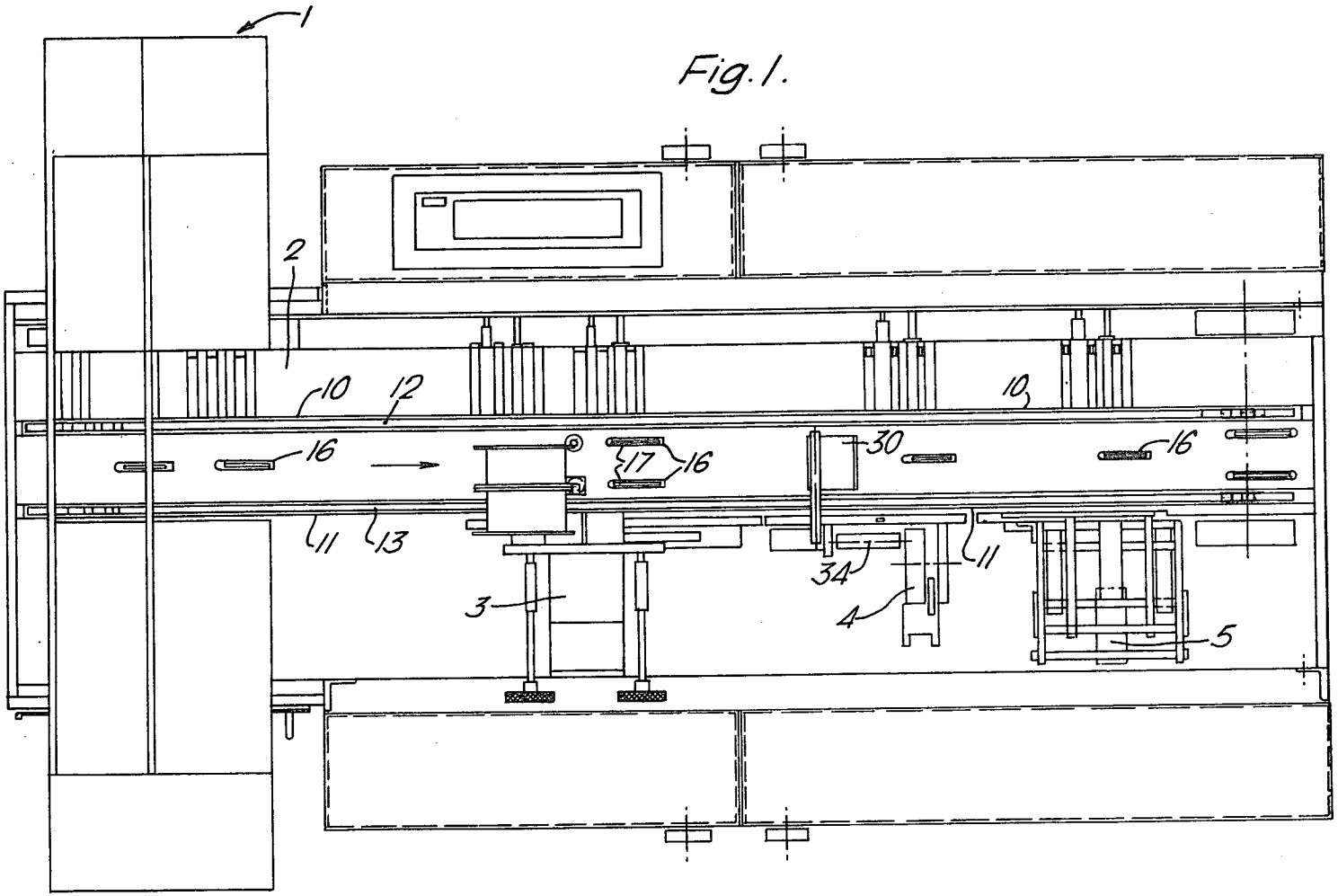
FIG. 1 illustrates the arrangement of a machine for stitching and binding cheque books, to which the invention may be applied.

In FIG. 1, the covers and the stack of cheques for a cheque book are transferred from a loading station 1 on to the track 2. They are advanced along the track 2 in the direction indicated by the arrow to a stitching station 3 at which two wire staples are passed through the covers and cheques along their back edge. The stitched books then proceed to a binding station comprising a tape applicator 4, at which one marginal portion of a length of binding tape is applied to the underside of the stitched cheque book so as to cover the ends of the wire staples, and a wrap-over unit 5 which rolls the tape around the back of the cheque book and over the marginal portion of the front cover, over the backs of the wire staples. The cheque book is then pushed off the conveyor end onto a stacking unit.

Figure 2:
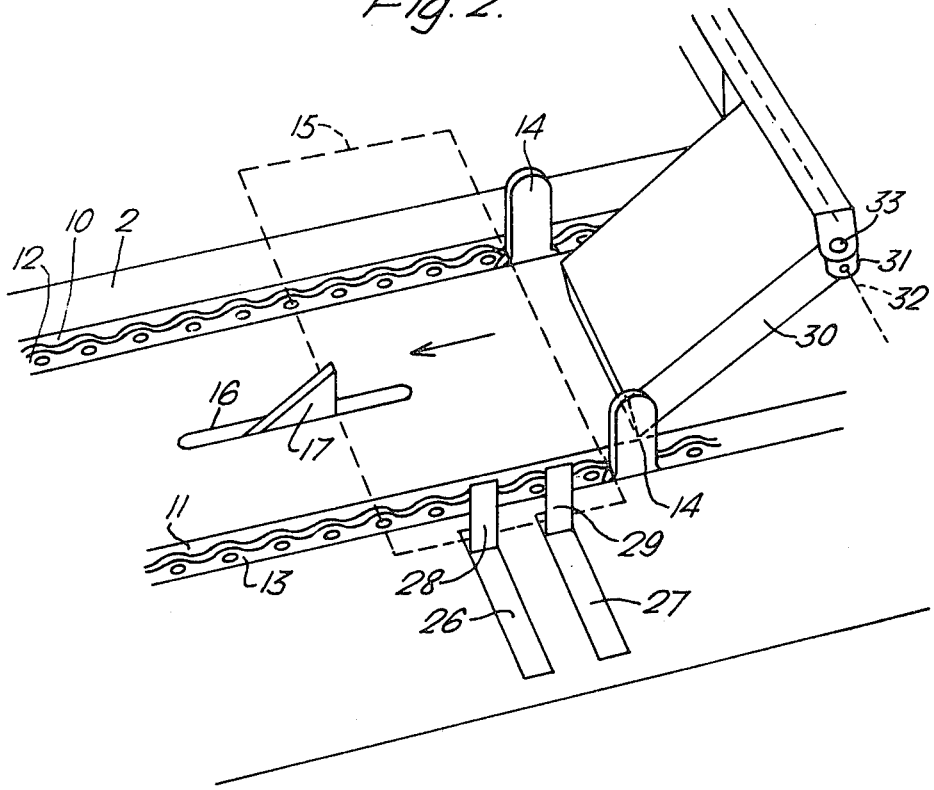
FIG. 2 illustrates a portion of the track and aligning mechanism of the machine shown in FIG. 1.

A conveyor embodying the invention is illustrated diagrammatically in perspective form in FIG. 2. The track surface 2 is broken by longitudinal slots 10 and 11 under which are chain conveyors 12 and 13 which are driven together. At intervals on the chain conveyor upstanding dogs 14 are attached to the chains, one pair of such dogs being shown in FIG. 2. These dogs act as pushing elements for a stack of cheques and covers, the position of which is indicated by the dotted rectangle 15.

At points adjacent the stations in the track there are provided slots 16 through which project resiliently mounted fingers 17. These do not move with the chain conveyor. They engage the the leading edge of a stack of sheets when it reaches the station position and act to align the leading edges of the sheets and to exert pressure on the leading edge of the stack while the operation is carried out on the stack.

A further advantage of the use of resilient fingers 17 is that no adjustment has to be made for quite large variations in the width of the cheque book, e.g. from $2\frac{3}{4}''$ to 4".

Figure 3:
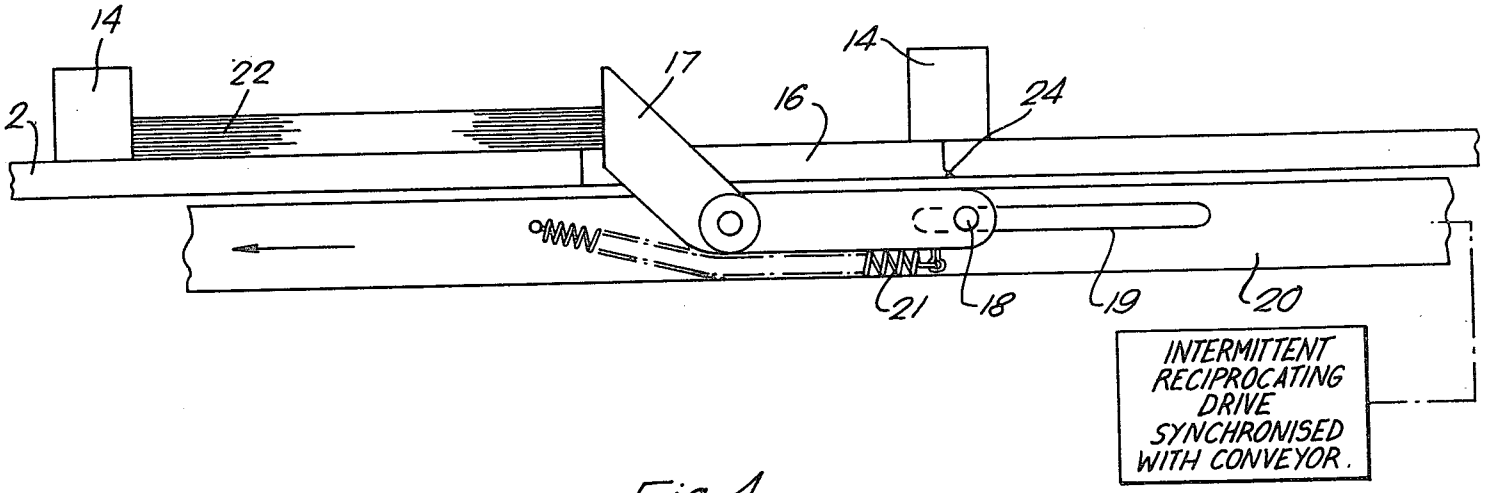
FIGS. 3 and 4 illustrate the operation of the device for aligning the leading edges of stacks of sheets in the apparatus of FIG. 1; and, FIGS. 5 and 6 are a side view and an end view repectively of means for positioning the stack of sheets on the track.
Figure 4:
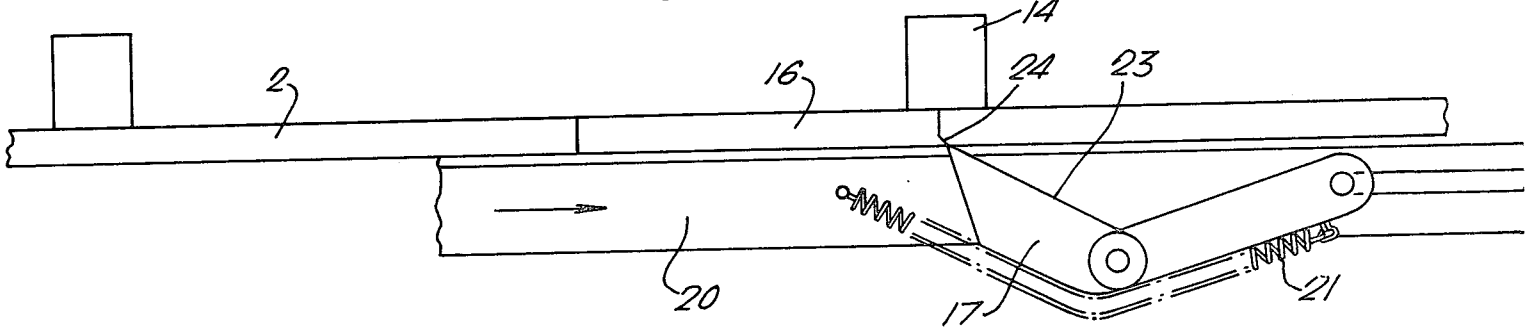

The manner in which the resilient fingers, constituting the leading-edge joggers, sink below the track is illustrated in FIGS. 3 and 4 of the accompanying drawings. The resiliently mounted fingers 17 are in fact angled links having at their ends remote from the stack-engaging end a pin 18 which extends into a slot 19 in a slide 20. A spring 21 connected at one end to the slide and at the other end to the angled link at a point close to the pin 18, urges the finger 17 to the left in FIGS. 3 and 4, so that when the stack 22 of sheets to be formed into a book is pushed by the chain-mounted dogs 14 along the track 2 to the right in the drawing, the leading edge of the sheet stack is resiliently engaged by the finger 17, which jogs the sheets into alignment. At this time, the slide 20 is in its extreme left position and the pin 18 moves along the slot 19 as far as is required to accommodate the stack 22 when the dogs 14 are halted at a station, for example the stitching station. When the stack is required to progress further along the track, the slide 20 is moved to the right (see FIG. 4). When the back edges 23 of the finger 17 encounters the cam surface 24 at the end of the slot 16, the angled finger 17 pivots about the pin 18, against the effect of the spring 21, and thereby sinks below the track. When the stack of sheets has passed by, the slide returns to the left and the finger 17 again emerges through the slot 16 in readiness for the next stack.

The movement of the slides is in timed relationship to the movement of the conveyor.

Lateral joggers 28 and 29 move in slots 26 and 27 in a direction transverse to the conveyor movement to align the ends of the cheques and covers.

As stated above, to position the cheque stack with greater accuracy, for example at the binding station, an additional positioning device can be used. In this example, the positioning device includes a plate 30 mounted freely between side members 31 so as to pivot under gavity about an axis 32. The side members are in turn fixed to a shaft 33. When a cheque book is moved along the track by the upstanding dogs 14 attached to the chain conveyors, it pushes the freely rotatable plate 30 out of the way and passes underneath it. Once the conveyor has stopped, for example in the position shown, the shaft 33 is rotated to a predetermined angular position and the outer edge of the plate 30, which will have dropped on to the track again after the passage of the cheque stack, slides along the track surface to push the trailing end of the cheque stack to an accurately defined position along the track.

Figure 5:
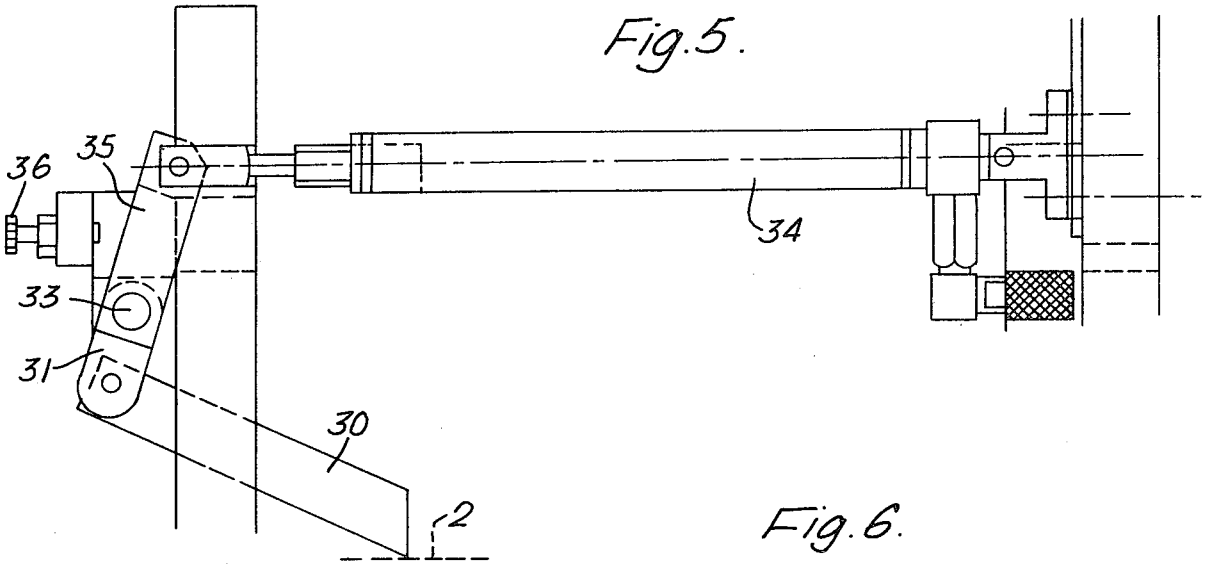
Figure 6:
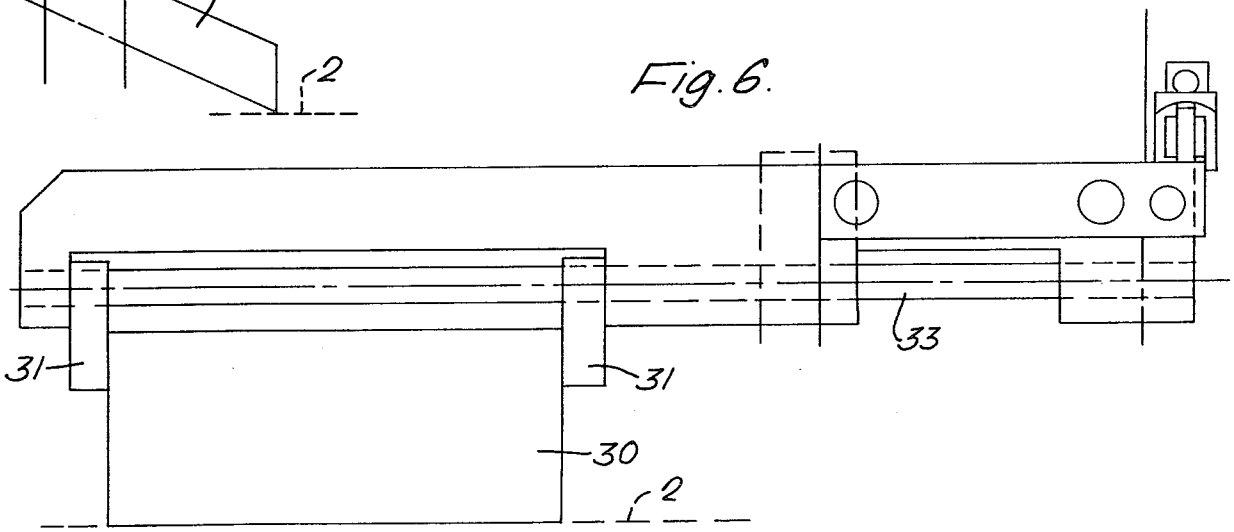

The operation of the positioning element is shown in greater detail in FIGS. 5 and 6, which are respectively a side view and an end view of the relevant portion of the apparatus. These figures show the positioning device 30 with one end resting on the track 2 and the other end freely pivoted between side members 31. A small air cylinder 34 operates in timed relation to the halting of the conveyor to pivot a member 35 about the axis of the shaft 33 and at the same time to pivot the side members 31 about this axis. It will be clear that the effect of this is to slide the lower edge of the plate 30 along the track 2 and in so doing to push the book to the required position.

An adjusting screw 36 controls the extent of forward movement of the plate 30 and hence the book position for binding.

We claim:

1. Sheet-conveying apparatus comprising stack-pushing means for engaging the trailing edge of a stack of sheets loaded on to a stationary conveyor track, a stack-aligning element movable between a first position in which it projects from the track so as to engage and align the leading edges of the sheets of a stack and a second position in which it is withdrawn below the track, and means for halting the stack-pushing means when the stack of sheets has been advanced along the track to a station at which an operation is to be performed on the stack, and further comprising mounting means positioning the stack-aligning element at the said station and comprising resilient means permitting yielding movement of the element in the direction of movement of the conveyor while the element is in its first position, so that the sheets are urged into alignment to form a compact stack between the said resiliently mounted stack-aligning element and the stack pushing means, and means operating in timed relationship with further movement of the conveyor for withdrawing the resiliently mounted element to the second position to permit the stack to advance beyond the said station.

2. Apparatus in accordance with claim 1, in which the said mounting means comprises a member having a slot extending parallel to the direction of movement of the said conveyor and a pin extending into the slot, the stack-aligning element being mounted for pivotal movement above the axis of the pin.

3. Apparatus in accordance with claim 2, further comprising a spring attached to the stack-aligning element and arranged to urge the stack-aligning element into its first position projecting from the track and towards one end of said slot.

4. Apparatus in accordance with claim 2 or 3, in which the stack-aligning element in the first position projects through a slot in the track and in which the means for withdrawing the stack-aligning element below the surface of the track comprises driving means operating in timed relationship with the said further movement of the conveyor to move the slotted member in a direction parallel to the direction of movement of the pushing means, and a cam surface at the rear end of the said slot in the track which urges the stack-aligning element downwards to its second position when the said slotted member and the pin are moved in the direction of movement of the pushing means.

5. Apparatus in accordance with any one of claims 1, 2 or 3, in which the pushing means comprises a pair of pushing elements attached to conveyor chains travelling below the level of the surface of the track.

6. Apparatus in accordance with claim 1, further comprising a positioning device arranged for movement into the said path of the sheet stack at a predetermined point immediately after a stack of sheets has passed that point and operative to push the stack against the resiliently mounted stack-aligning element to a predetermined position.

7. Apparatus in accordance with claim 6, in which the positioning device comprises a plate freely mounted between side members and mounted for pivotal movement about an axis parallel to the axis of a shaft to which the side members are attached, the distance between the shaft and the track being such that the plate normally lies inclined to the track with its edge remote from the shaft resting on the track, the plate and the track presenting an acute angle to an advancing stack of sheets and the plate being pushed upwards by the stack and falling by gravity back onto the track when the stack has passed.

* * * * *